US006371793B1

(12) United States Patent
Doorhy et al.

(10) Patent No.: US 6,371,793 B1
(45) Date of Patent: Apr. 16, 2002

(54) LOW CROSSTALK MODULAR COMMUNICATION CONNECTOR

(75) Inventors: Michael Doorhy, Tinley Park; Andrew J. Stroede, Mokena; Russell A. Vanderhoof, Minooka, all of IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/138,969

(22) Filed: Aug. 24, 1998

(51) Int. Cl.[7] ..... H01R 4/24; H01R 4/26; H01R 11/20

(52) U.S. Cl. ..... 439/404; 439/941; 439/676; 439/405

(58) Field of Search ..... 439/676, 941, 439/404, 405

(56) References Cited

U.S. PATENT DOCUMENTS

| | | | | |
|---|---|---|---|---|
| 3,565,807 | A | 2/1971 | Siverisen et al. | 428/189 |
| 4,153,325 | A | 5/1979 | Asick | 439/405 |
| 4,392,701 | A | 7/1983 | Weidler | 439/76.1 |
| 4,409,608 | A | 10/1983 | Yoder | 357/51 |
| 4,651,340 | A | 3/1987 | Marson | 379/155 |
| 4,731,833 | A | 3/1988 | Gumb et al. | 379/399 |
| 4,756,695 | A | 7/1988 | Lane et al. | 439/76 |
| 4,767,338 | A | 8/1988 | Dennis et al. | 439/55 |
| 4,968,260 | A | 11/1990 | Ingalsbe | 439/76 |
| 4,975,078 | A | 12/1990 | Stroede et al. | 439/405 |
| 5,055,966 | A | 10/1991 | Smith et al. | 361/321 |
| 5,069,641 | A | 12/1991 | Sakamoto et al. | 439/620 |
| 5,091,826 | A | 2/1992 | Arnett et al. | 361/776 |
| 5,178,554 | A | 1/1993 | Siemon et al. | 439/188 |
| 5,295,869 | A | 3/1994 | Siemon et al. | 439/620 |
| 5,299,956 | A | 4/1994 | Brownell et al. | 439/638 |
| 5,326,284 | A | 7/1994 | Bohbot et al. | 439/676 |
| 5,399,106 | A | 3/1995 | Ferry | 439/620 |
| 5,414,393 | A | 5/1995 | Rose et al. | 333/1 |
| 5,431,584 | A | 7/1995 | Ferry | 439/620 |
| 5,432,484 | A | 7/1995 | Klas et al. | 333/1 |
| 5,435,752 | A | 7/1995 | Siemon et al. | 439/620 |
| 5,488,201 | A | 1/1996 | Liu | 174/262 |
| 5,513,065 | A | 4/1996 | Caveney et al. | 361/311 |
| 5,577,937 | A | 11/1996 | Itoh et al. | 439/620 |

(List continued on next page.)

FOREIGN PATENT DOCUMENTS

| | | |
|---|---|---|
| WO | WO 97/44862 | 11/1997 |

*Primary Examiner*—Brian Sircus
*Assistant Examiner*—Javaid Nasri
(74) *Attorney, Agent, or Firm*—Robert A. McCann

(57) ABSTRACT

A modular communications connector includes a housing defining a plug receiving opening, a conductor carrying sled including a printed circuit board designed in conjunction with the conductors to improve crosstalk performance. The connector includes a wire containment fixture arrangement allows for simplified field termination of the modular connector. The connector is assembled by loading the contacts and printed circuit board onto the sled, which is snap fit into the housing. Then, wires are positioned through the wire containment fixture and the fixture is slidably engaged with the sled at a first position and slid along the sled to a second position where the wires are terminated with IDCs mounted on the sled. The connector preferably includes first and second pluralities of conductors, with the second plurality each having IDC portions arranged in first and second rows of four IDCs. The top and bottom IDC portion at each end of the rows terminates an associated wire pair and the two internal IDC portions of each row terminates an associated wire pair. The connector also preferably includes a printed circuit board that is engageable with both the first and second plurality of conductors. The printed circuit board has at least three layers, with a pair of outer layers containing traces that complete an electrical path between the IDCs of the second plurality of conductors and a corresponding first end portion of the first plurality of conductors. One or more capacitors are provided on an inner layer of the printed circuit board.

17 Claims, 11 Drawing Sheets

U.S. PATENT DOCUMENTS 5,586,914 A 12/1996 Foster, Jr. et al. ..... 439/676
5,636,099 A 6/1997 Sugawara et al. ..... 361/278
5,679,027 A 10/1997 Smith ..... 439/676
5,700,167 A 12/1997 Pharney et al. ..... 439/676
5,716,237 A 2/1998 Conorich et al. ..... 439/660
5,885,111 A * 3/1999 Yu ..... 439/676
6,102,741 A * 8/2000 Boutros et al. ..... 439/676
6,183,306 B1 * 2/2001 Caveney ..... 439/676

* cited by examiner 10
12
42
36
38
34
32
30
40
22
22
24
25
25
50

LOW CROSSTALK MODULAR COMMUNICATION CONNECTOR

TECHNICAL FIELD

The present invention relates to modular communication connectors and more particularly to a modular communication connector that utilizes a printed circuit board design and conductor arrangement to provide for improved crosstalk performance and also provides for simplified wire termination.

BACKGROUND OF THE INVENTION

Standard telephone jack connectors and other modular connectors of generally similar design are well known in the communications industry. However, along with the constantly increasing signal transmission rates exists the need for modular communication connectors to have improved crosstalk performance. It is also important for these connectors to continue to have simple field termination capability. Thus, increasing performance requirements for communication connectors establish a need in the art of modular communication connectors to be economically manufactured which can be easily field terminated and that will achieve higher levels of suppressing crosstalk interference.

SUMMARY OF THE INVENTION

It is an object of the present invention to provide a modular communication connector with improved crosstalk performance.

It is another object of the present invention to provide a modular communication connector with simplified field terminability.

In general, a modular communications connector, includes a housing defining a plug receiving opening, a conductor carrying sled supporting a plurality of conductors each including an insulation displacement contact (IDC) portion disposed extending rearwardly in a direction generally parallel to an axis of entry of the plug receiving opening; and a wire containment fixture having means for positioning wires with respect to the IDC portions, said fixture being engageable to and slidably movable along a portion of the conductor carrying sled. The connector also utilizes a printed circuit board design incorporating capacitors which in conjunction with the conductor design improves the overall crosstalk performance. The IDC portions of the conductors are arranged in upper and lower rows of four IDC portions each such that the top and bottom IDC portion at each end of the rows terminates a wire pair and the two internal IDC portions of each row terminates a wire pair and the printed circuit board includes at least three layers with the outer layers containing a plurality of traces for interconnecting the first and second plurality of conductors, and formed on an inner layer of the PCB for affecting the crosstalk performance of the connector.

DESCRIPTION OF THE PREFERRED EMBODIMENT

Figure 1:
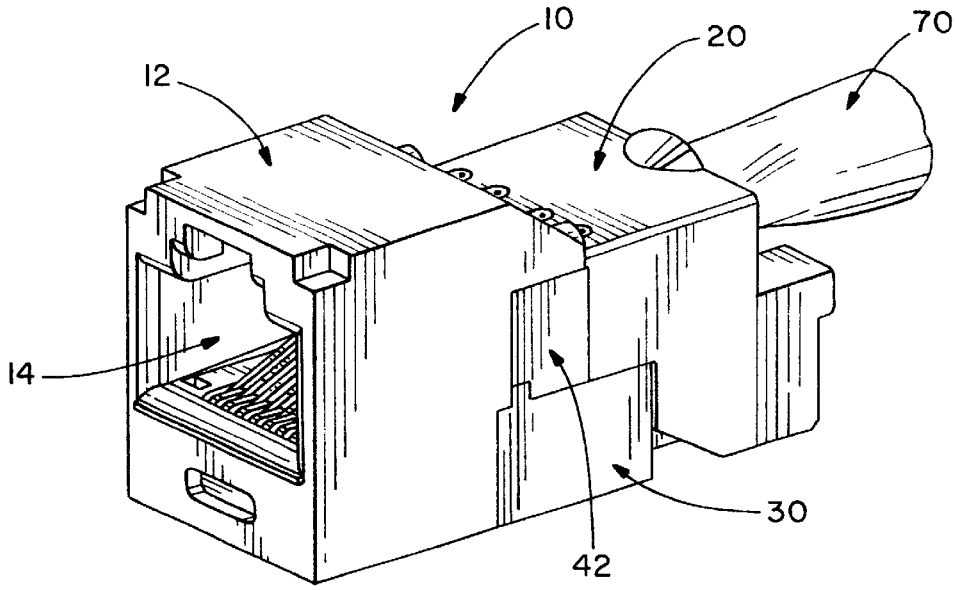
FIG. 1 is a front perspective view of a free standing modular communication connector embodying the concept of the present invention.
Figure 2:
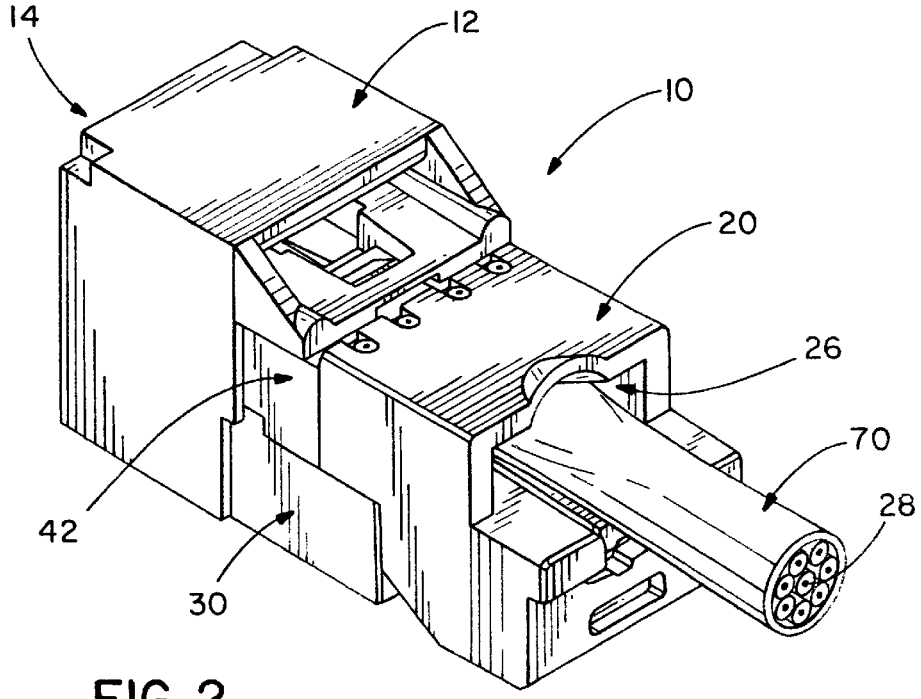
FIG. 2 is a rear perspective view of the connector of FIG. 1.
Figure 3:
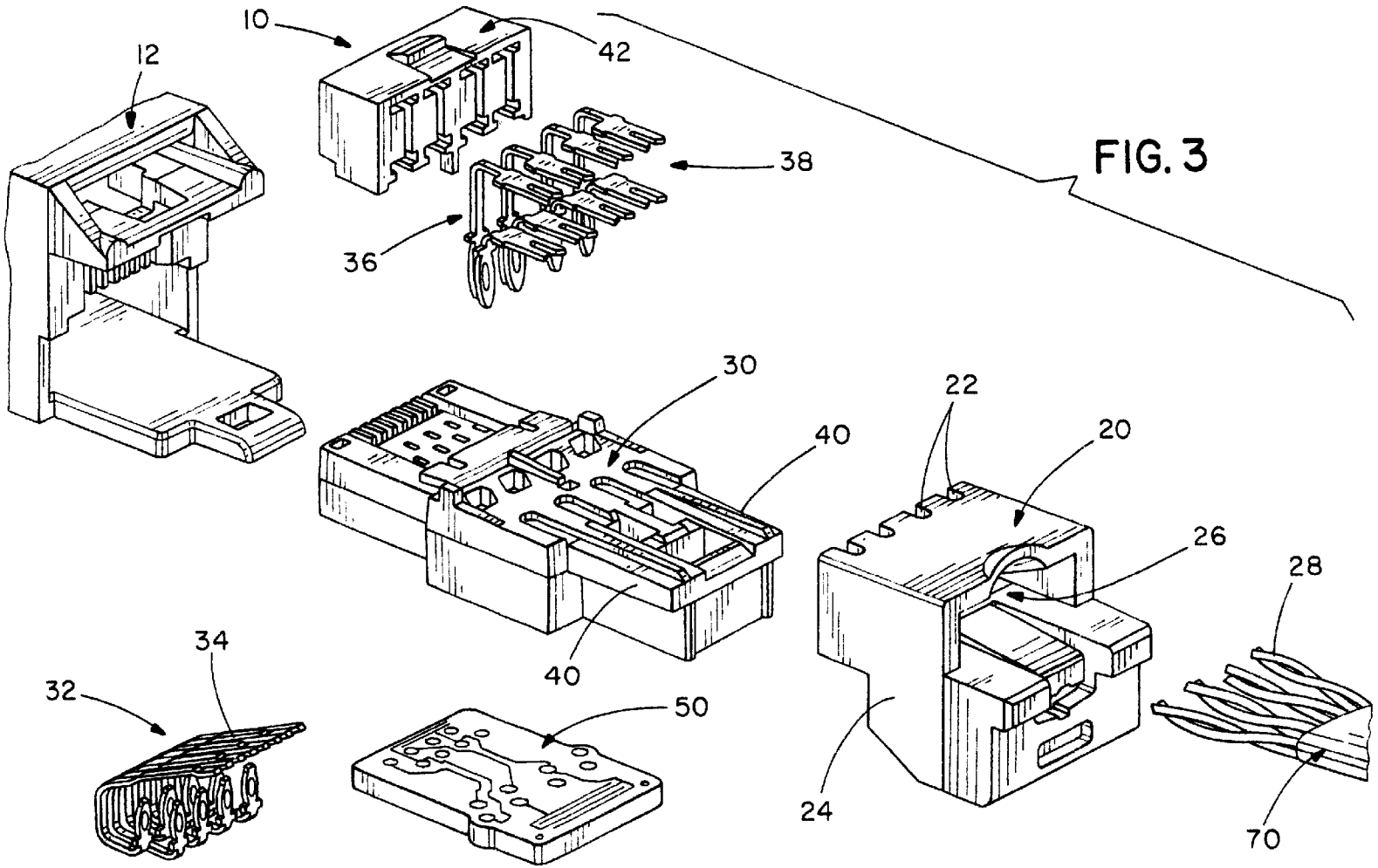
FIG. 3 is a rear perspective exploded view of the connector of FIG. 1.
Figure 4:
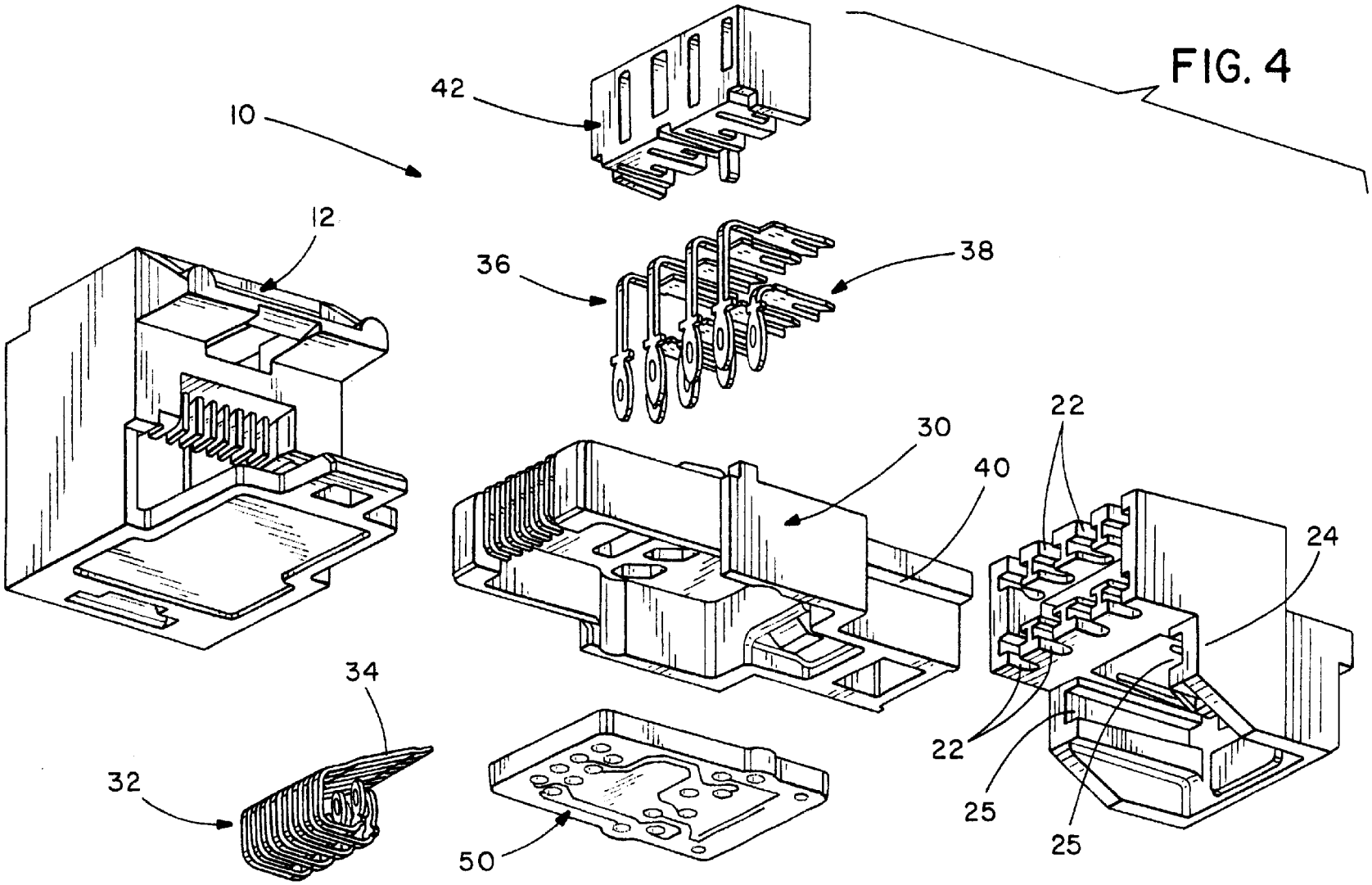
FIG. 4 is a bottom perspective exploded view of the connector of FIG. 1.
Figure 5:
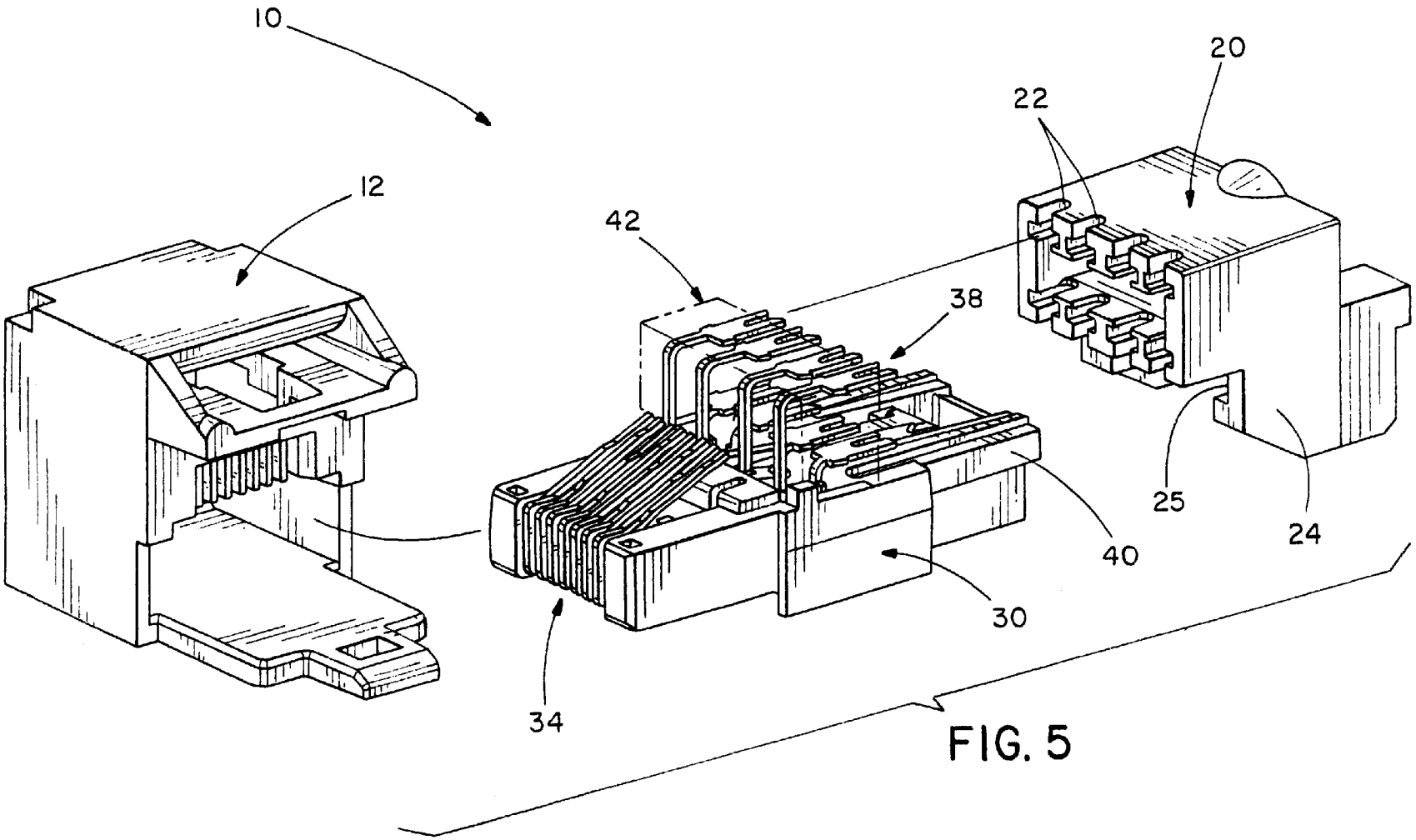
FIG. 5 is a subassembly view of the connector of FIG. 1 showing the sled prior to engagement with the housing.

A modular communication connector embodying the concept of the present invention is designated generally by the reference numeral 10 in the accompanying drawings. As shown in FIGS. 1 and 2, connector 10 includes a housing 12 defining a plug receiving opening 14, a conductor carrying sled 30 and a wire containment fixture 20 for terminating a communication cable 70 having a plurality of individual communication wires 28.

Figure 8:
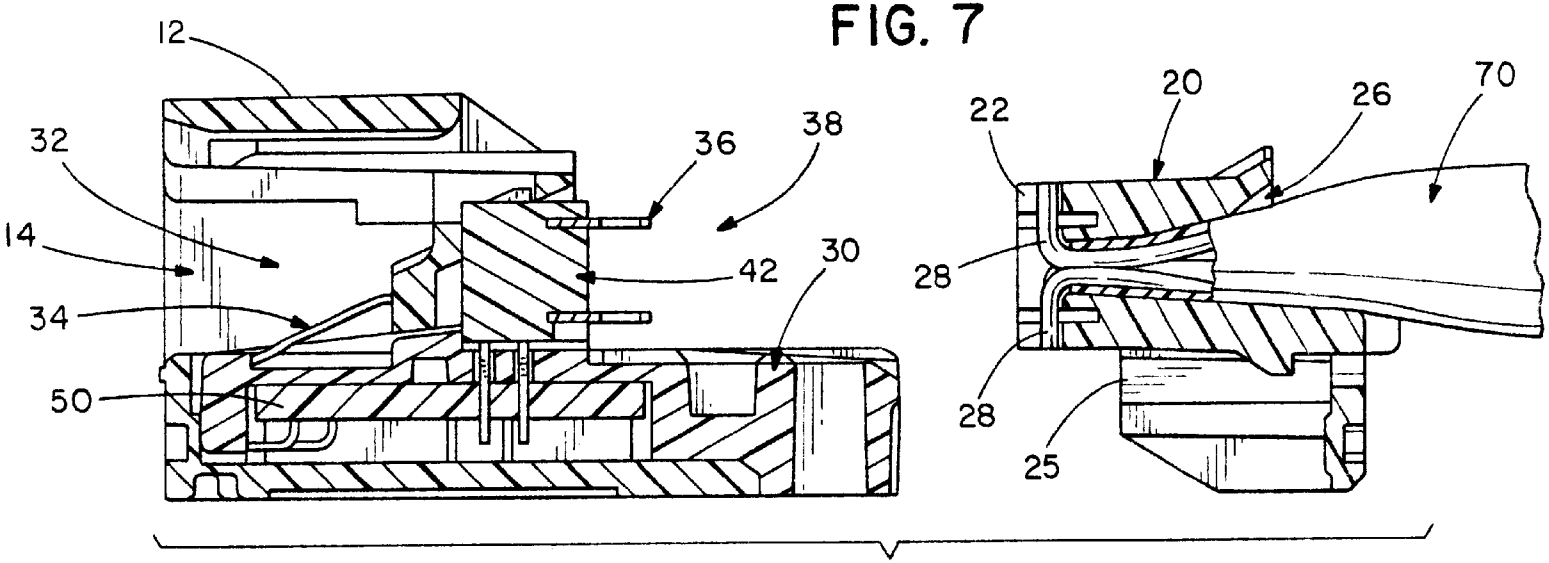
FIG. 8 is a sectional view taken along line 8—8 of FIG. 7.
Figure 9:
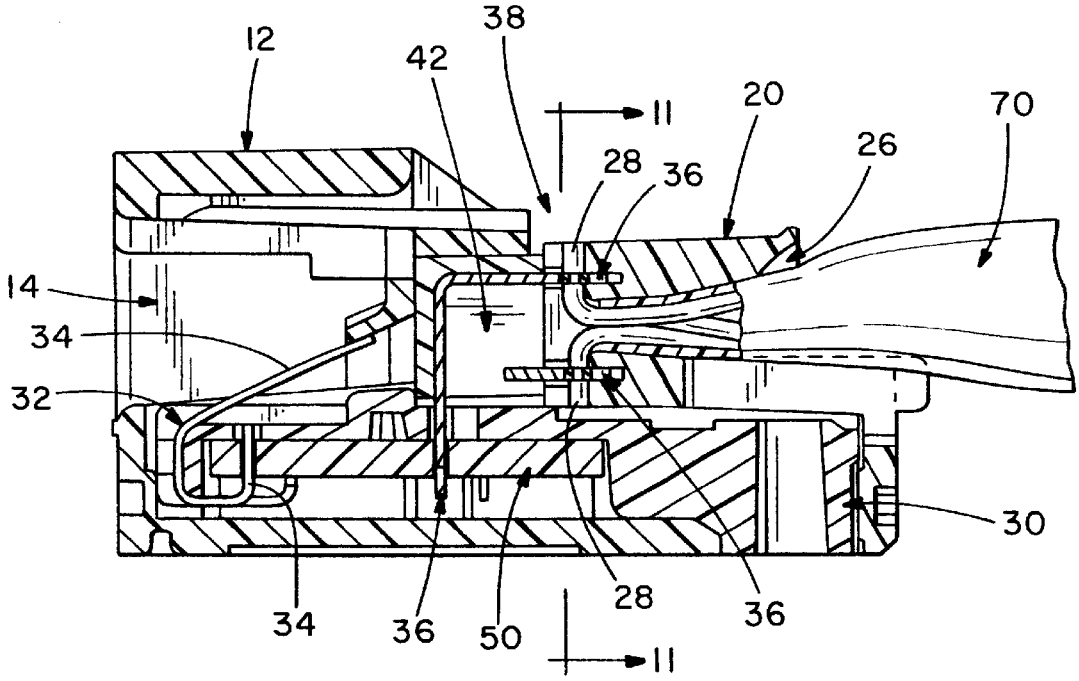
FIG. 9 is a sectional view taken along line 9—9 of FIG. 7.
Figure 10:
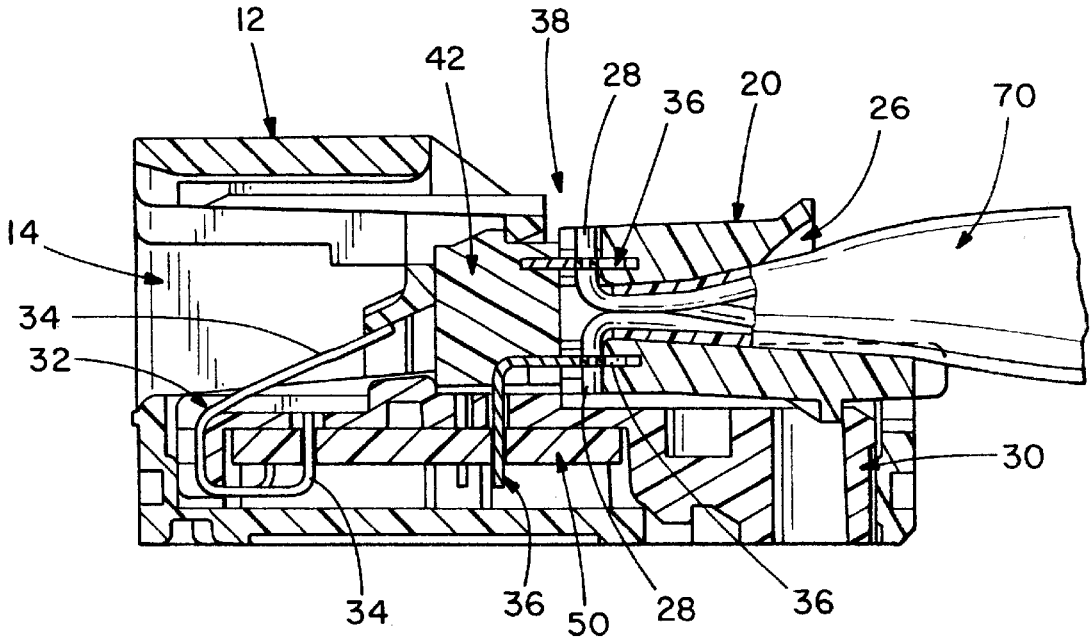
FIG. 10 is a sectional view taken along lines 10—10 of FIG. 7.
Figure 11:
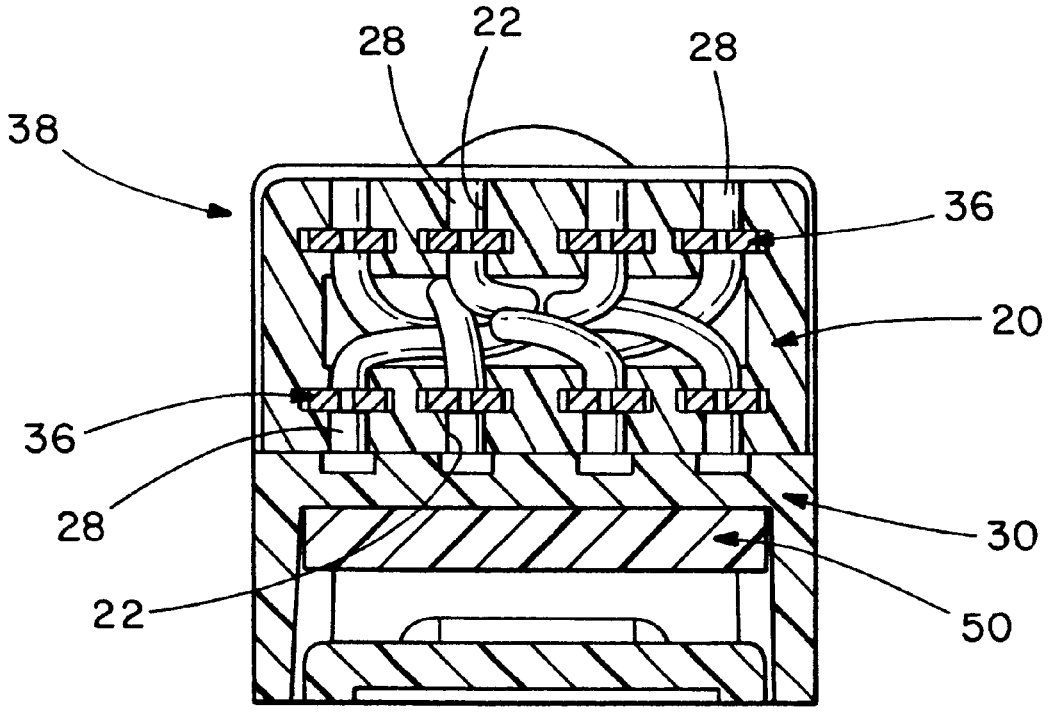
FIG. 11 is a sectional view taken along lines 11—11 of FIG. 9.
Figure 12:
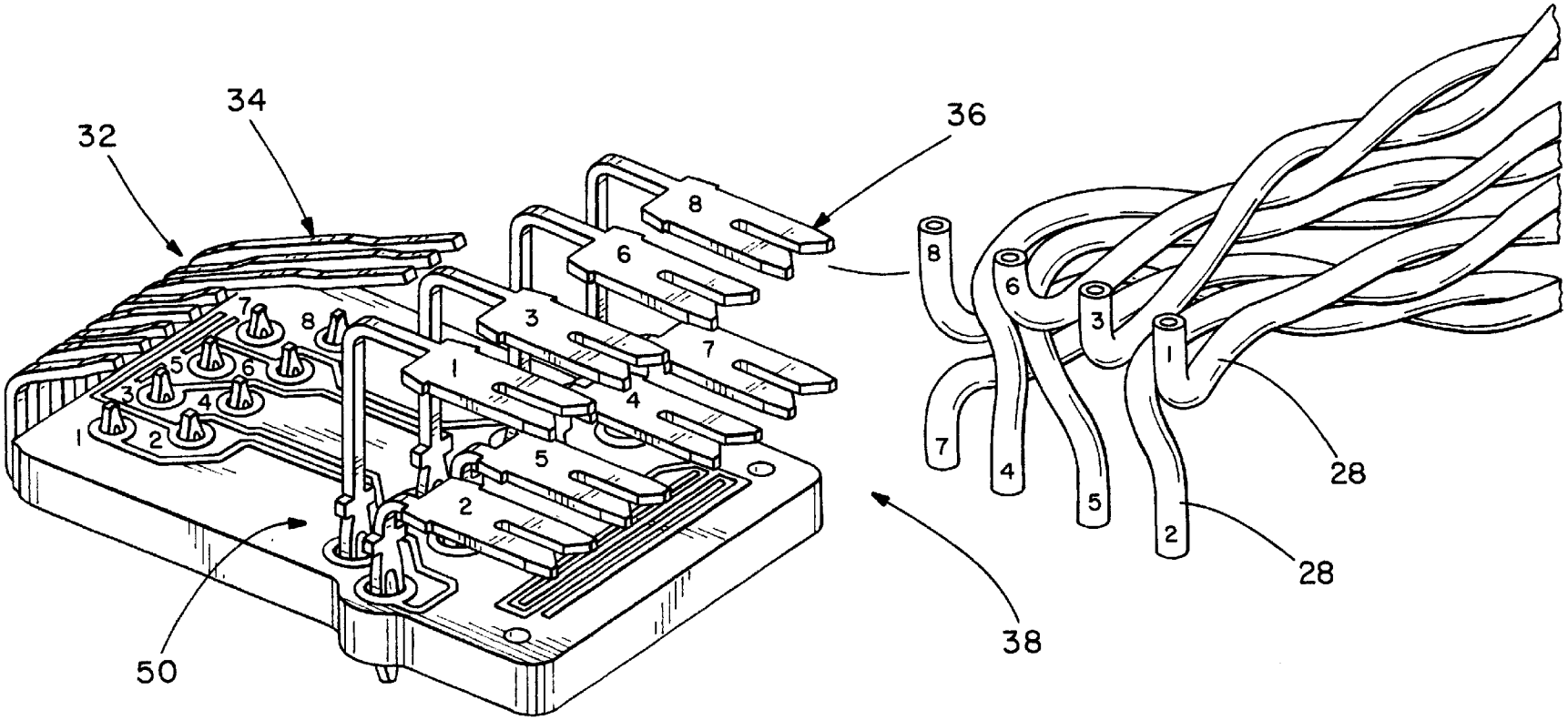
FIG. 12 is a perspective view of the twisted wire pairs shown without the wire containment fixture and the contact arrangement of the PCB shown without the housing, sled and IDC block.
Figure 15:
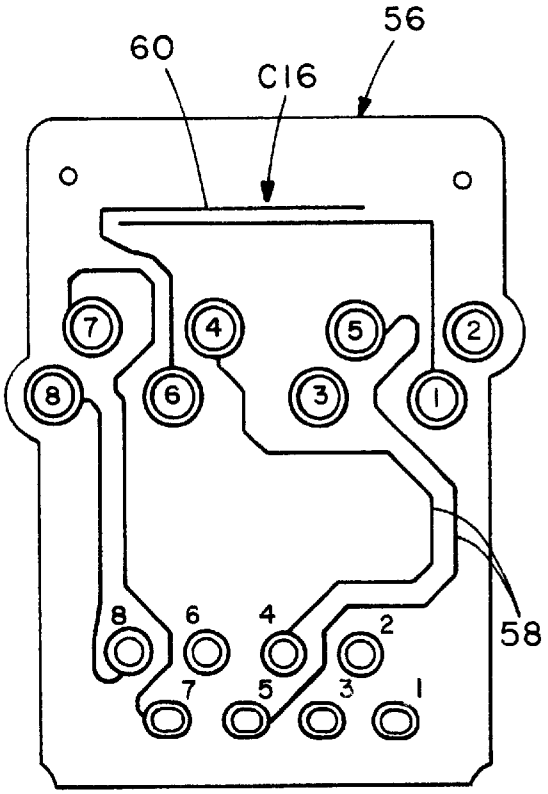
FIG. 15 is a plan view of the bottom layer of the printed circuit board.
Figure 14:
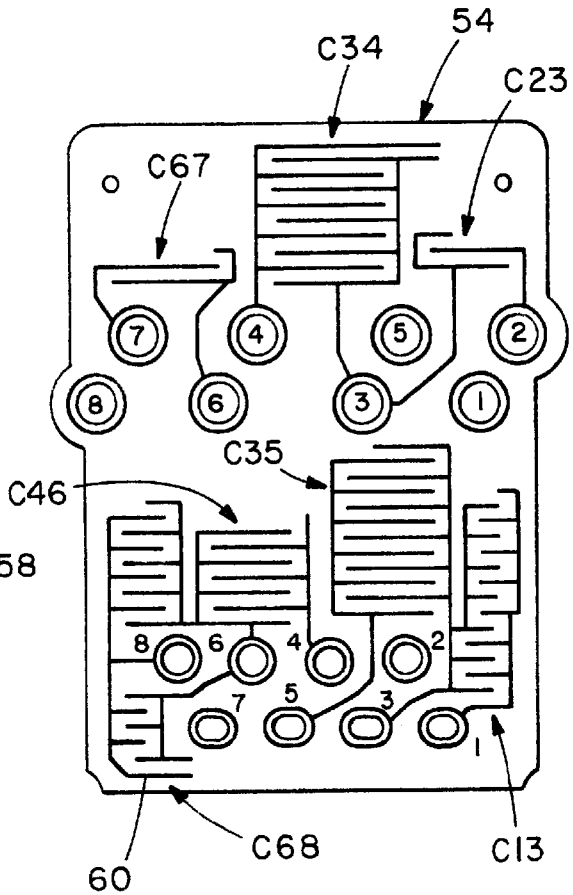
FIG. 14 is a plan view of the second layer which is identical to the third layer of the printed circuit board.
Figure 13:
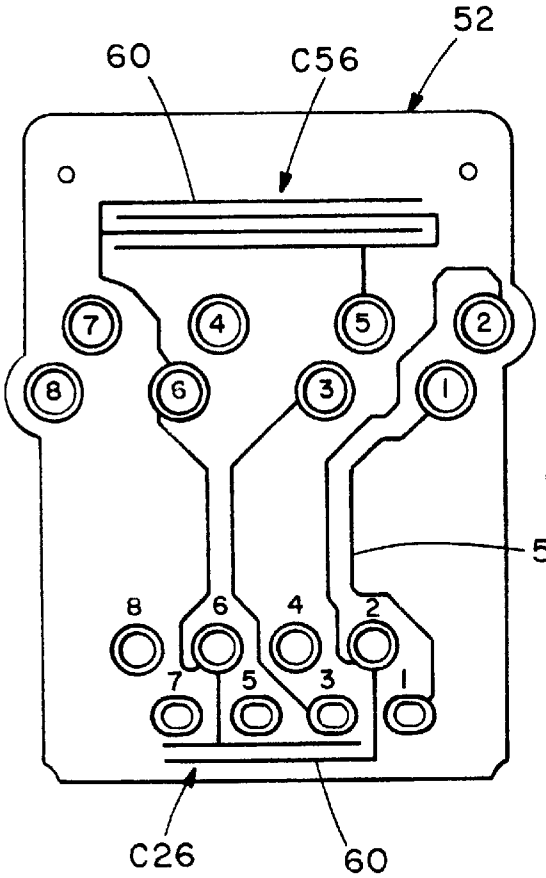
FIG. 13 is a plan view of the top layer of the circuit board.
Figure 16:
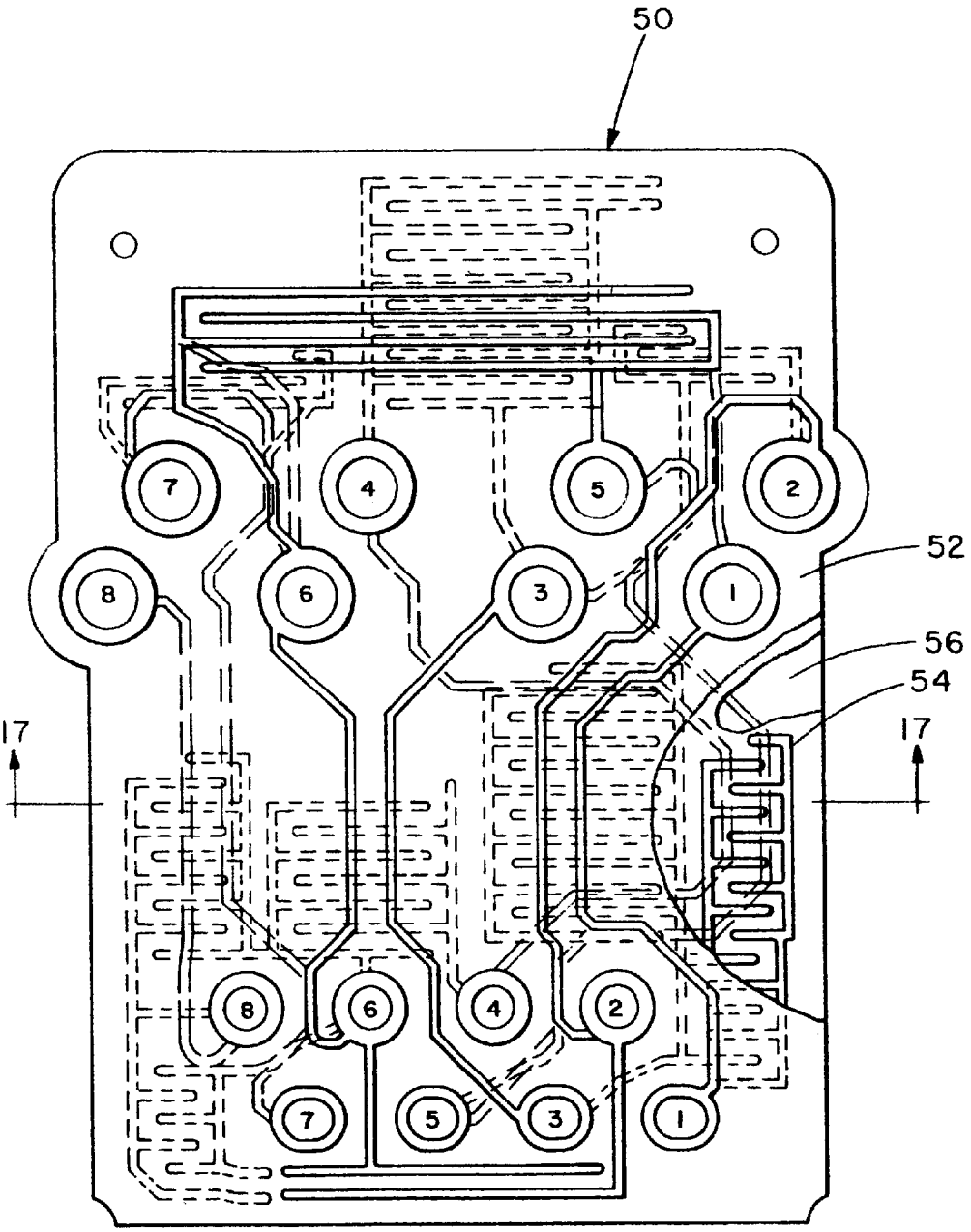
FIG. 16 is a plan view of the PCB with portions broken away to see the lower layers.
Figure 17:
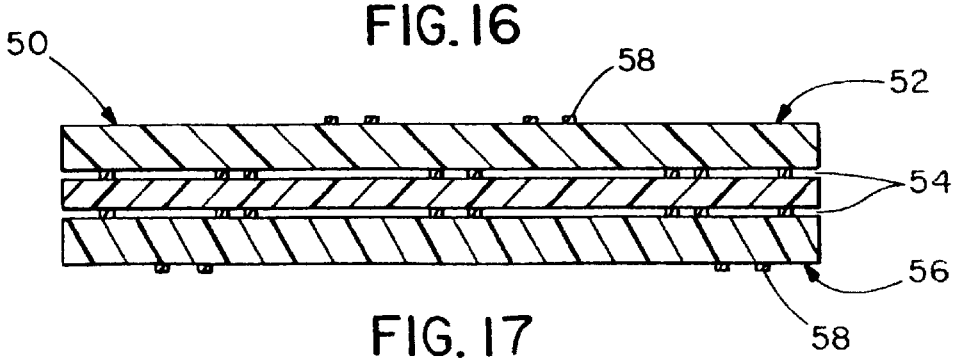
FIG. 17 is a sectional view of the printed circuit board taken along lines 17—17 of FIG. 16.

As can be seen in FIGS. 3–6, connector 10 includes a conductor carrying sled 30 that supports a printed circuit board (PCB) 50 and a first and second plurality of conductors. The first plurality of conductors 32 each have a resilient contact portion 34 at a first end which is to be disposed within the plug receiving opening in accordance with a standard telephone plug mating configuration. The standards for the connector interface provides for eight laterally spaced conductors numbered 1–8, wherein the conductor pairs are defined by the associated wire pairs in accordance with the standard. Specifically, the standard pair arrangement provides for wires 4 and 5 comprising pair 1, wires 3 and 6 comprising pair 2, wires 1 and 2 comprising pair 3, and wires 7 and 8 comprising pair 4. As shown in FIGS. 8 and 12, each of the conductors 32 also includes a compliant pin at the second end so that the conductors 32 can be secured to the PCB 50 without requiring soldering.

Figure 6:
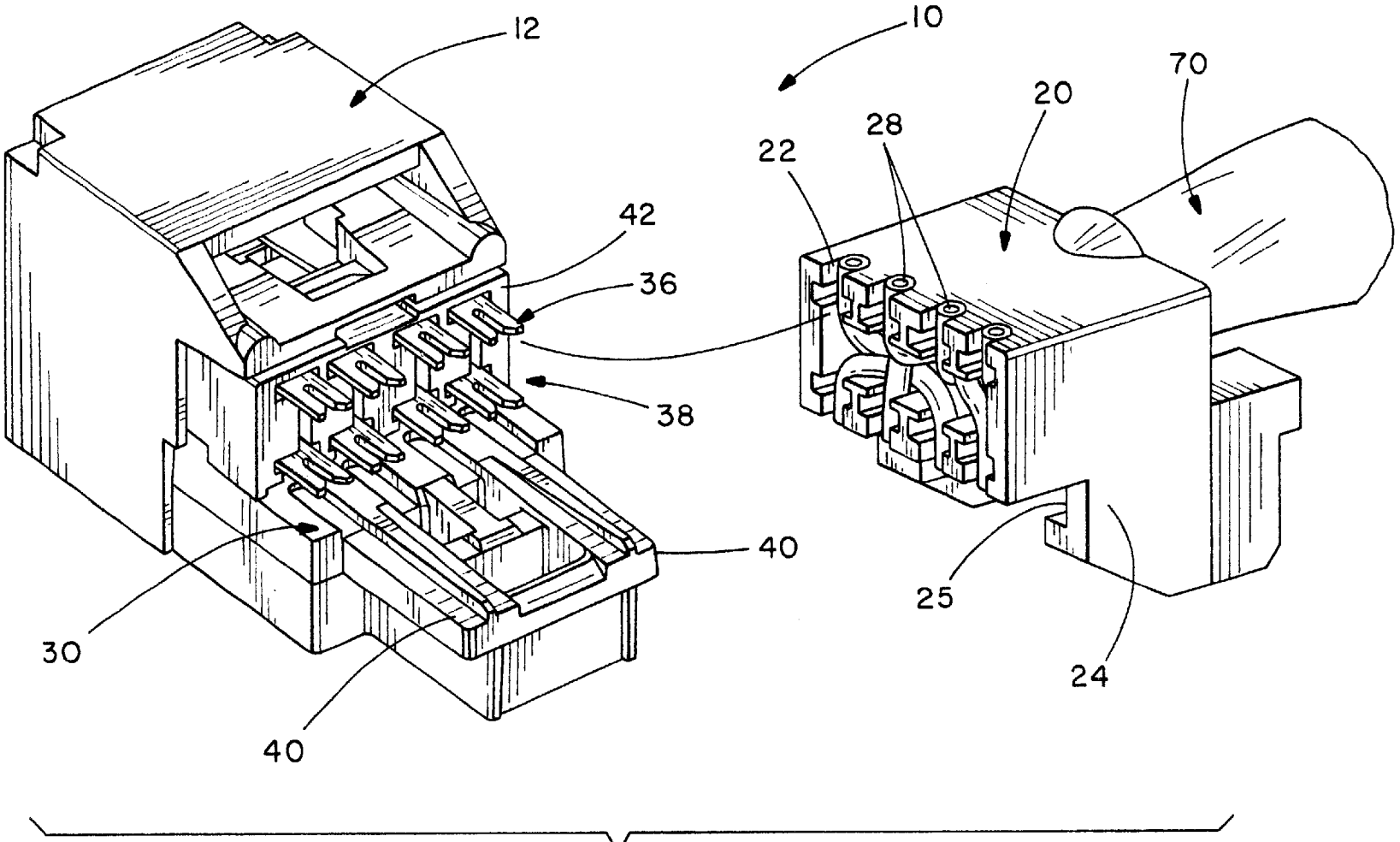
FIG. 6 is a subassembly view of the connector of FIG. 1 shown prior to termination by the wire containment fixture.
Figure 7:
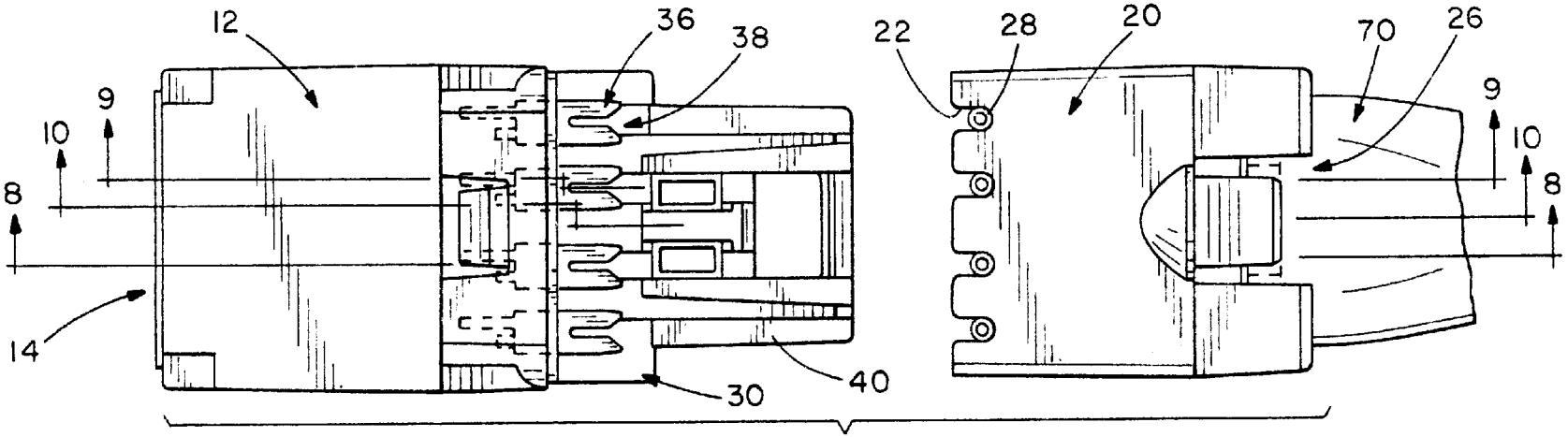
FIG. 7 is a top view of the connector of FIG. 1 shown prior to termination by the wire containment fixture.

The second plurality of conductors 36 each includes a compliant pin at one end for engagement with the PCB 50 and an IDC portion 38 at the second end. The second plurality of conductors 36 are configured such that the IDC portions 38 are disposed extending rearwardly in a direction generally parallel to an axis of entry of the plug receiving opening 14. The axis of entry is the generally horizontal direction in which a standard telephone plug type connector would be inserted in order to mate with the resilient contacts of the connector. The second plurality of conductors are initially loaded into an IDC block 42 which is used to aid in the manufacturing and assembly process. The IDC block 42 has locating pockets and a peg for accurate positioning on the sled 30. After assembling the PCB 50 and conductors 32, 36 in position on sled 30, the sled is inserted into the rear end of the housing such that resilient contact portions 34 of the first plurality of conductors 32 are disposed within the plug receiving opening 14 of housing 12 and the IDC portions 38 extend horizontally away from the back end in position for termination of the individual wires 28 as shown in FIG. 6. Latches on the housing secure the sled in position.

As can be seen in FIGS. 3, 4, 6 and 8, the wire containment fixture 20 has a cable opening 26 that allows both flat and round cable to be loaded into the wire containment fixture. The front end of wire containment fixture 20 includes eight individual vertically aligned wire slots 22. Thus as the twisted pair conductors of the cable are brought through the opening, the individual wires can be routed into their respective wire slots 22. A label indicating the wiring scheme can be placed on the wire containment fixture 20 for providing the user instructions. Engagement walls 24 including guide slots 25 are provided on fixture 20 beneath the wire slots 22 and are formed to engage with a pair of guide rails 40 disposed on each lateral edge of the rearward end of sled 30 to allow for sliding movement of fixture 20 along sled 30 and to provide for proper wire location during termination.

In general, in communications connectors, some crosstalk effect is occurring at every portion along adjacent conductors of the connector. That is, crosstalk occurs between adjacent conductors at the resilient contact portions of the plug mating end, between adjacent contacts on the PCB, as well as between adjacent IDC portions. It is in the preferred embodiment shown that the overall crosstalk performance of the connector is enhanced through a combination of minimizing crosstalk interaction between adjacent conductors where possible and utilizing capacitors on a unique PCB design to balance the overall crosstalk effect.

As can be seen in FIGS. 13–16, the printed circuit board 50 is a four layer board with a plurality of through holes formed through all four layers, each of which corresponds respectively with one of the compliant pin ends of one of the first or second plurality of conductors 32, 36. The top 52 and bottom 56 outer layers contain the traces 58 for interconnecting the first and second plurality of conductors 32, 36 via their respective conductive through holes. The two inner layers 54 are identical to each other and is shown only once in FIG. 14. Seven of the ten capacitors 60 which are utilized in the proposed design for crosstalk reduction are housed in the middle two layers 54. The outer layers 52, 56 also include three capacitors 60 which in the preferred design were not placed in the middle layers 54 due to space and capacitor layout constraints.

As can be seen, the conductor traces 58 within a pair are of relatively the same length and run nearby each other to obtain a proper impedance for return/loss performance and to reduce possible far end crosstalk (FEXT) effect. It is to be noted that the thickness of the traces can also be adjusted to achieve the required impedance. Additionally, certain contact pairs have the traces 58 run on opposite sides of the board to minimize is near end crosstalk (NEXT) in that area. For example, traces 4 and 5, and 7 and 8 for pairs 1 and 4 respectively are disposed on the bottom board, whereas traces 3 and 6, and 1 and 2 for pairs 2 and 3 respectively are disposed on the top board.

Capacitance is added to the PCB in order to compensate for the crosstalk which occurs between adjacent conductors of different pairs throughout the connector arrangement. The capacitance can be added in several ways. The capacitance can be added as chips to the board or can be integrated into the board using pads or finger capacitors.

In the preferred embodiment shown, capacitors are added in the form of finger or interdigitated capacitors connected to conductor pairs. The capacitors are identified by the conductor to which they are connected and to which capacitance is added to balance the crosstalk effect seen by the other conductor of a pair. For example, C46 identifies the finger capacitor connected to conductors 4 and 6 to balance the crosstalk seen between conductors 4 and 6 with the crosstalk seen between conductors 5 and 6 throughout the connector.

As can best be seen in FIG. 12, the IDC portions 38 for terminating pairs of wires of the communication cable are arranged in two rows of four IDC portions. The contacts are configured such that the top and bottom IDC portion at each end of the rows terminates a wire pair and the two internal IDC portions of each row terminate a wire pair. Specifically, as previously discussed the standard pair arrangement is wires 4 and 5 are pair 1, wires 3 and 6 are pair 2, wires 1 and 2 are pair 3 and wires 7 and 8 are pair 4. The standard in the industry sets forth that the odd wires are the tip and the even wires are the ring of the pair. As best seen in FIG. 12, pair 3 comprising contacts 1 and 2 and pair 4 comprising contacts 7 and 8 are disposed respectively at the left and right ends of the two rows of IDC portions. Pair 2 comprising contacts 3 and 6 is disposed on the upper row at the two internal IDC portions and pair 1 comprising contacts 4 and 5 is disposed in the bottom row within the two inner IDC portions. This specific IDC arrangement improves crosstalk performance by minimizing any additional undesired crosstalk while helping to balance existing crosstalk effects found in the standard plug and jack contact arrangement. Furthermore, this IDC layout allows for pairs to remain twisted as close to the IDC's as possible which helps decrease the crosstalk needed to be balanced in the connector. Thus, the IDC arrangement allows for a simplified PCB capacitor design.

In the field, the preassembled housing 12 and sled 30 containing the printed circuit board 50, first plurality of contacts 32, second plurality of contacts 36 and IDC block 42 is provided such that the plug mating resilient contact portions 34 are disposed within the plug receiving opening 14 and the IDC portions 38 are horizontally disposed for accepting the individual wires 28. The communication cable 70 is inserted into the opening 26 of the wire containment fixture 20, the individual wires 28 are inserted into the respective wire slots 22 and the excess wire cut off. Finally, the wire containment 20 having the engagement walls 24 with guide slots 25 is assembled onto sled 30 via the guide rails 40 and slid forward until proper termination is achieved and locked in position by a cantilevered snap latch.

While the particular preferred embodiments of the present invention have been shown and described, it will be obvious to those skilled in the art that changes and modifications may be made without departing from the teachings of our invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A modular communications connector, comprising:

a housing defining a plug receiving opening;

a conductor carrying sled supporting a plurality of conductors each including an insulation displacement contact (IDC) portion having at least a pair of tines disposed extending rearwardly in a direction generally parallel to an axis of entry of the plug receiving opening; and a wire containment fixture having means for positioning wires with respect to the IDC portions, and being engageable to the sled, wherein after engagement with the sled at a first position on the sled, the fixture is slidably movable along a portion of the sled from the first position to a second position along the portion of the sled where wires contained in said wire containment fixture terminate with corresponding IDC portions.

2. The modular communications connector according to claim 1, wherein the fixture includes a pair of engagement walls each including a pair of inwardly disposed flanges forming guide slots for cooperating with a pair of guide rails respectively formed on the sled.

3. The modular communications connector according to claim 1, wherein the sled further supports a printed circuit board (PCB) having means for reducing crosstalk interference between associated pairs of the conductors.

4. The modular communications connector according to claim 3, wherein the printed circuit board includes at least three layers with the outer layers containing a plurality of traces that interconnect a first and second plurality of conductors, and capacitors formed on an inner layer of the PCB that affect crosstalk performance of the connector.

5. The modular communications connector according to claim 1, wherein the sled upon engagement with the housing positions a plurality of resilient contact portions within the plug receiving opening.

6. The modular communications connector according to claim 1, wherein the fixture includes a cable receiving aperture extending through said fixture in a direction generally parallel to the tines of the IDC.

7. A modular communications connector, comprising:

a housing defining a plug receiving opening at a first end;

a sled supporting a printed circuit board engageable with the housing;

a first plurality of conductors each having a resilient contact portion at a first end situated within the plug receiving opening and a second end adapted to be connected to the printed circuit board (PCB);

a second plurality of conductors each having a first end adapted to be connected with the PCB and an insulation displacement contact (IDC) portion at a second end; and a wire containment fixture having means for positioning wires with respect to the IDC portions and being engageable to the sled, wherein after engagement with the sled at a first position on the sled, the fixture is slidably moveable along a portion of the sled from the first position to a second position along the portion of the sled where wires contained in said wire containment fixture terminate with corresponding IDC portions.

8. The modular communications connector according to claim 6, wherein the means for positioning wires includes a plurality of vertically aligned wire slots disposed at a front end of the fixture.

9. The modular communications connector according to claim 6, wherein the IDC portions include at least a pair of tines disposed extending rearwardly in a direction generally parallel to an axis of entry of the plug receiving opening.

10. The modular communications connector according to claim 6, wherein the PCB includes means for reducing the crosstalk effect on the conductors.

11. The modular communications connector according to claim 6, wherein the PCB further comprises four layers with a top and a bottom layer including traces interconnecting the first and second plurality of conductors.

12. The modular communications connector according to claim 11, wherein a pair of inner layers include capacitors for reducing the crosstalk effect on the conductors.

13. The modular communications connector according to claim 7, wherein the fixture includes a cable receiving aperture extending through said fixture in a direction generally parallel to the tines of the IDC.

14. A modular communications connector including a housing defining a plug receiving opening having therein a first plurality of conductors each having a portion arranged in accordance with a standard telephone wiring configuration, the connector further comprising:

a second plurality of conductors each having insulation displacement contact (IDC) portions at a first end that terminate pairs of wires of a communication cable and a second end interconnected to a corresponding one of the first plurality of conductors, wherein the IDC portions are arranged in an upper and a lower row of four IDC portions each such that the top and bottom IDC portion at each end of the rows terminates an associated wire pair and the two internal IDC portions of each row terminating an associated wire pair wherein the IDC portions include at least a pair of tines disposed extending rearwardly in a direction generally parallel to an axis of entry of the plug receiving opening said connector further including a conductor carrying sled and a wire containment fixture, wherein the wire containment fixture includes means for positioning wires with respect to the IDC portions, said fixture being engageable to and slidably movable along a portion of the conductor carrying sled.

15. A modular communications connector including a housing defining a plug receiving opening having a first plurality of conductors each having a first end portion arranged in accordance with a standard telephone wiring configuration and a second portion adapted to be connected to a printed circuit board, and a second plurality of conductors having insulation displacement contact (IDC) portions that terminate wires of a communication cable and a second portion adapted to be connected to a printed circuit board, comprising:

a printed circuit board (PCB) engageable with both the first and second plurality of conductors having at least three layers with a pair of outer layers containing a plurality of traces that interconnect individual ones of the first plurality of conductors with a corresponding one of the second plurality of conductors to complete an electrical signal path between the IDC of the corresponding one second plurality of conductors and the first end portion of the corresponding one of the first plurality of conductors; and capacitors formed on an inner layer of the PCB for affecting crosstalk performance of the connector.

16. The modular communications connector according to claim 15, wherein the PCB includes two inner layers both having capacitors formed thereon.

17. The modular communications connector according to claim 16, wherein the two inner layers are identical.

* * * * *